United States Patent [19]

Benton

[11] 3,952,306

[45] Apr. 20, 1976

[54] SERRODYNE GENERATOR

[75] Inventor: Noel B. Benton, Laurel, Md.

[73] Assignee: The United States of America as represented by the Secretary of the Air Force, Washington, D.C.

[22] Filed: Feb. 4, 1970

[21] Appl. No.: 12,479

[52] U.S. Cl. ..... 343/18 E; 328/183; 328/185

[51] Int. Cl.[2] ..... H04K 4/50

[58] Field of Search ..... 328/181, 183, 185; 343/18 E; 307/228

[56] References Cited

UNITED STATES PATENTS

| | | | |
|---|---|---|---|
| 3,569,735 | 3/1971 | Lavender | 328/185 X |
| 3,571,617 | 3/1971 | Hainz | 328/181 X |
| 3,577,007 | 5/1971 | Cross | 328/185 X |

*Primary Examiner*—T. H. Tubbesing
*Attorney, Agent, or Firm*—Joseph E. Rusz; George Fine

[57] ABSTRACT

A serrodyne generator providing a constant peak amplitude sawtooth signal wherein a voltage controlled multivibrator (VCM) determines the frequency at which a capacitor is discharged with the VCM frequency being varied by a common sweep signal. In order to maintain a constant amplitude, the current source for the capacitor is swept at the same rate as the VCM by the common sweep signal.

2 Claims, 1 Drawing Figure

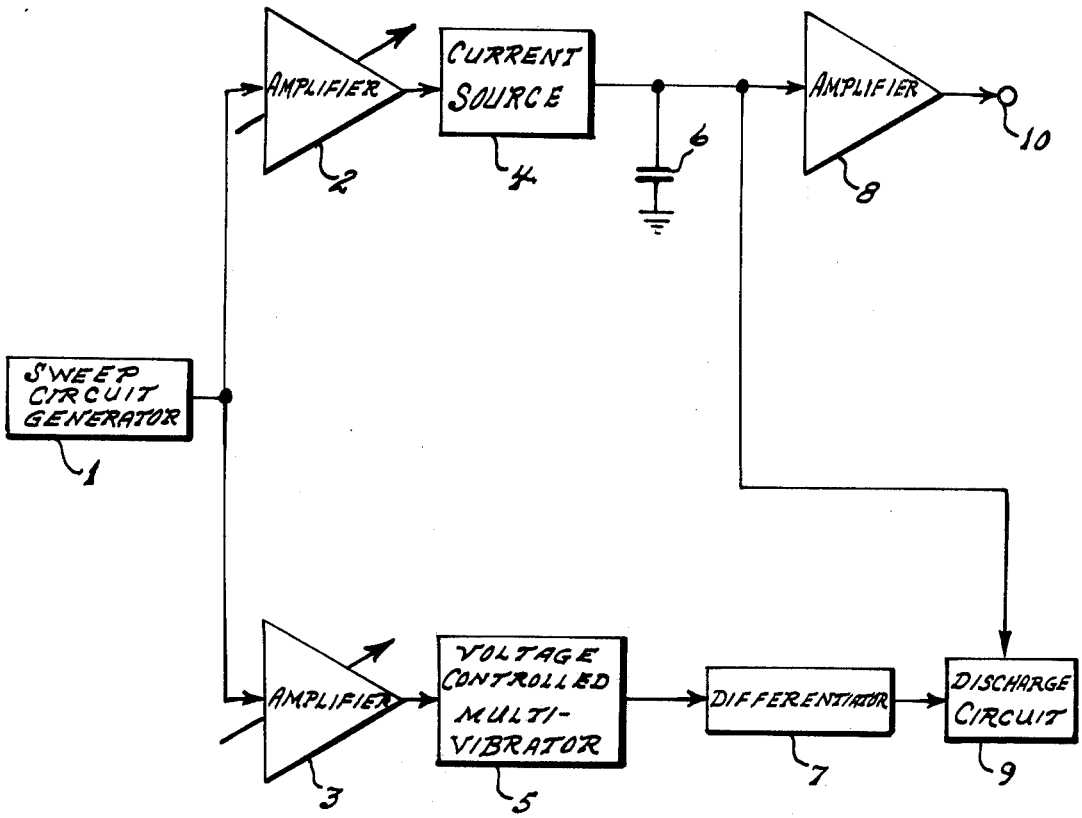
INVENTOR.
NOEL B. BENTON
BY Harry A. Herbert Jr. and George Fine
ATTORNEYS

SERRODYNE GENERATOR

BACKGROUND OF THE INVENTION

This invention relates to a serrodyne generator and more particularly a serrodyne generator providing a constant amplitude serrodyne signal.

It is often necessary in electronic countermeasures systems to frequency modulate the output signal in such a way that the frequency variation is similar to that caused by the doppler effect. A serrodyne circuit is used to accomplish this by varying the transit time of the signal in the output amplifier (traveling wave tube). The transit time is a function of the helix voltage of the traveling wave tube (TWT) and thus by varying the helix voltage, a frequency shift can be produced. The serrodyne circuit must generate a constant peak amplitude, variable frequency sawtooth wave in order to produce the desired frequency shift.

In the past, the serrodyne circuit consisted of a current source to linearily charge a capacitor and a unijunction transistor to set a threshold level and discharge the capacitor. The current source was varied in order to charge the sawtooth frequency. This proved satisfactory at frequencies up to 10kc, however, due to the delay time of the unijunction, at frequencies above 10kc, a variation in amplitude occurs as the frequency is swept.

In order to generate a serrodyne signal at frequencies above 10kc, the present invention was devised in which a threshold circuit is not used to control the sawtooth amplitude and the frequency is independent of current source.

SUMMARY OF THE INVENTION

A serrodyne generator is provided. The frequency of the serrodyne signal is controlled by a voltage controlled multivibrator (VCM). The voltage controlled multivibrator determines the frequency at which a capacitor is discharged. The VCM frequency is varied by a sweep signal (either linear or parabolic) from a common sweep signal source and the VCM frequency range is set by adjusting the gain and output DC level of a first amplifier interposed between the common sweep signal source and the VCM.

In order to maintain a constant amplitude serrodyne signal, a current source for the capacitor is swept at the same rate as the VCM. The peak amplitude of the serrodyne signal is set by adjusting the output DC level of a second amplifier interposed between the common sweep signal source and the current source. The peak amplitude can be adjusted to be constant over the frequency range by adjusting the gain of the second amplifier.

An object of the invention is to provide a serrodyne generator in which the output waveforms are automatically maintained at a constant peak amplitude while the frequency thereof vary.

Another object of the invention is to provide a serrodyne generator in which the frequency of the serrodyne signal is controlled by a voltage controlled multivibrator.

Still another object of the invention is to provide a serrodyne generator in which a voltage controlled multivibrator determines at which frequency a capacitor is discharged.

Yet another object of the invention is to provide a serrodyne generator in which a voltage controlled multivibrator varied by a sweep signal determines the frequency at which a capacitor is discharged and simultaneously the current source for the capacitor is also varied by the same sweep signal.

BRIEF DESCRIPTION OF THE DRAWING

The single FIGURE of the drawing shows a block diagram of the improved serrodyne generator of the present invention.

DESCRIPTION OF THE PREFERRED EMBODIMENT

Referring to the single FIGURE of the invention, there is shown sweep circuit generator 1 which may be of the conventional type such as a sawtooth generator. The output from sweep circuit 1 is, in this instance, a sawtooth waveform and is utilized as a sweep signal. Sweep circuit 1 may also be of the type that provides a linear or parabolic output. The sweep signal from sweep circuit 1 is fed simultaneously to conventional variable DC amplifiers 2 and 3. The output of amplifier 2 is fed to conventional current source 4. The output of current source 4 is connected simultaneously to one end of discharge capacitor 6, the input of amplifier 8 and to the first input of conventional discharge circuit 9. Discharge capacitor 6 is connected at its other end to ground. The output of amplifier 3 is fed to the input of conventional voltage controlled multivibrator 5 with the output from multivibrator 5 being fed to differentiator 7. The differentiated signal is fed to a second input of discharge circuit 9.

In the operation of the serrodyne generator, a common sweep signal is fed to voltage controlled multivibrator 5 by way of variable amplifier 3. The voltage controlled multivibrator provides a pulse output which is differentiated and fed to one input of discharge circuit 9. Thus the voltage controlled multivibrator determines the frequency at which capacitor 9 is discharged. It is noted that the voltage controlled multivibrator is varied by a sweep signal with the voltage controlled multivibrator frequency range set by adjusting the gain and output DC level of amplifier 3.

In order to maintain a constant amplitude serrodyne signal, current source 4 is swept at the same rate as voltage controlled multivibrator 5. The peak amplitude of the serrodyne signal is set by adjusting the output DC level of amplifier 2 and the peak amplitude is adjusted to be constant over the frequency range by adjusting the gain of amplifier 2. The output serrodyne signal is present at terminal 10 and it has the capability of maintaining a constant peak amplitude with frequency variation and flyback time.

I claim:

1. A serrodyne generator for electronic countermeasures to provide automatically a serrodyne signal of constant peak amplitude over a selected frequency range comprising single generator means to provide a predetermined single sweep signal, first and second DC amplifiers, each of said DC amplifiers having the gain and DC level output thereof adjustable, a current source having an input and output, said first DC amplifier interconnecting said single generator means and said input of said current source, with the DC output level of said first DC amplifier being set to adjust the peak amplitude of said serrodyne signal to a predetermined value and the gain of said first DC amplifier being adjusted to maintain said peak amplitude constant over said selected frequency range, a capacitor connecting said output of said current source to ground, a discharge circuit having first and second inputs, with said first input being connected to said output of said current source, a voltage controlled multivibrator having an input and output, said second DC amplifier interconnecting said single generator means and said input of said voltage controlled multivibrator, a differentiator interconnecting said second input of said discharge circuit and said output of said voltage controlled multivibrator, said voltage controlled multivibrator determining the discharge frequency of said capacitor with the frequency of said voltage controlled multivibrator being varied by said sweep signal by setting said gain and DC output level of said second DC amplifier.

2. A serrodyne generator for electronic countermeasures as described in claim 1 further including a third amplifier receiving an output signal from said capacitor and providing an output being said serrodyne signal.

* * * * *